US006113654A

United States Patent [19]

Peterson

[11] Patent Number: 6,113,654

[45] Date of Patent: Sep. 5, 2000

[54] CARPET CLEANING COMPOSITION

[76] Inventor: David Peterson, 3645 Dunsmuir Cir., Pleasanton, Calif. 94588

[21] Appl. No.: 08/713,273

[22] Filed: Sep. 12, 1996

[51] Int. Cl.[7] ..... D06L 1/04; C11D 1/72; C11D 3/395; C11D 3/43

[52] U.S. Cl. ..... 8/137; 510/278; 510/280; 510/303; 510/309; 510/337; 510/342; 510/356; 510/360; 510/370; 510/421

[58] Field of Search ..... 510/278, 280, 510/303, 309, 337, 342, 356, 360, 370, 421; 8/111, 137

[56] References Cited

U.S. PATENT DOCUMENTS

| | | | |
|---|---|---|---|
| 3,607,760 | 9/1971 | McIntyre | 252/104 |
| 3,748,268 | 7/1973 | Loudas | 252/90 |
| 3,775,052 | 11/1973 | Van Paassen | 8/137 |
| 3,835,071 | 9/1974 | Allen et al. | 252/545 |
| 3,994,744 | 11/1976 | Anderle et al. | 134/4 |
| 4,124,542 | 11/1978 | Devine | 252/546 |
| 4,238,192 | 12/1980 | Kandathil | 8/111 |
| 4,395,347 | 7/1983 | McLaughlin et al. | 252/139 |
| 4,490,270 | 12/1984 | Hackett et al. | 252/106 |
| 4,552,692 | 11/1985 | Gillespie | 252/528 |
| 4,557,898 | 12/1985 | Greene et al. | 422/28 |
| 4,566,980 | 1/1986 | Smith | 252/8.6 |
| 4,886,615 | 12/1989 | Dehan | 252/90 |
| 4,889,652 | 12/1989 | Sullivan et al. | 252/99 |
| 4,892,673 | 1/1990 | Dixit et al. | 252/114 |
| 5,002,684 | 3/1991 | Beck et al. | 252/105 |
| 5,019,289 | 5/1991 | Gray et al. | 252/95 |
| 5,106,523 | 4/1992 | Peterson | 252/95 |
| 5,118,436 | 6/1992 | Aoyagi et al. | 252/99 |
| 5,269,960 | 12/1993 | Gray et al. | 252/174.12 |
| 5,338,475 | 8/1994 | Corey et al. | 252/102 |
| 5,458,802 | 10/1995 | Sanderson et al. | 252/186.31 |
| 5,492,540 | 2/1996 | Leifheit et al. | 8/111 |
| 5,534,167 | 7/1996 | Billman | 510/280 |
| 5,602,090 | 2/1997 | Melikyan et al. | 510/372 |
| 5,712,240 | 1/1998 | Tyerech et al. | 510/424 |
| 5,728,669 | 3/1998 | Tyerech | 510/280 |
| 5,750,487 | 5/1998 | Oldenhove et al. | 510/365 |
| 5,785,887 | 7/1998 | Steltenkamp et al. | 252/186.42 |

FOREIGN PATENT DOCUMENTS

| | | |
|---|---|---|
| WO95/34630 | 12/1995 | WIPO . |
| WO95/34631 | 12/1995 | WIPO . |
| WO96/15308 | 5/1996 | WIPO . |

OTHER PUBLICATIONS

Griffith, Robert, "Solubility Parameters", *American Ink Maker*, Dec. 1989:15–17.

Hansen, C., "The Three Dimensional Solubility Parameter—Key to Paint Component Affinities: II and III", *Journal of Paint Technology*, 39 (No. 511):505–510 (1967).

Hansen, C., "III. Independent Calculation of the Parameter Components", *Journal of Paint Technology*, 39 (No. 511):505–510 (1967).

Wisniewski, R., et al., "Three–dimensional solubility parameters: simple and effective determination of compatibility regions", *Progress in Organic Coatings*, 26:265–274 (1995).

*Primary Examiner*—Gregory R. Del Cotto

*Attorney, Agent, or Firm*—Burns Doane Swecker & Mathis L.L.P.

[57] ABSTRACT

A cleaning composition for carpets, rugs, and the like is provided. The dispensable cleaner includes: a) an effective amount of an organic solvent having a Hansen solubility parameter of less than about 10; b) an effective amount of an emulsifying or dispersing agent; c) an effective amount of a source of hydrogen peroxide; and d) the balance being water. Emulsifying or dispersing agents that are surfactants having an HLB of less than about 10 are particularly suited for removing oily soil from absorbent or adsorbent surfaces. Optional components include sequestering agents, fragrances, builders and soil retardants.

14 Claims, No Drawings

CARPET CLEANING COMPOSITION

FIELD OF THE INVENTION

The present invention relates generally to carpet cleaners and particularly to a cleaning composition that includes hydrogen peroxide, a hydrophobic solvent, and an emulsifying or dispersing agent.

BACKGROUND OF THE INVENTION

A variety of carpet cleaning formulations are available for household use. Some are aerosol foam forming compositions that are dispensed from cans whereby after the foam collapses into the carpet some of the solvents in the composition interact with the dirt in the carpet which is later removed by vacuum. Other carpet cleaning formulations are aqueous compositions containing a variety of solvents, surfactants, and adjuvants. A number of these include hydrogen peroxide in combination with hydrophilic solvents and surfactants.

Despite their convenience, conventional carpet cleaning formulations suffer from a number of disadvantages. With respect to aqueous non-foaming formulations, while they are able to remove water soluble stains, they have not been particularly effective in removing heavy traffic soil stains. Thus one resorts to vigorous scrubbing with a wet mop, sponge, or other means in conjunction with more caustic cleaning formulations in the hopes of dissolving and removing the greasy stains. This latter type of formulation causes fabric damage and negates the convenience associated with these carpet cleaners.

SUMMARY OF THE INVENTION

The present invention is directed to a cleaning composition that is particularly suited for cleaning carpets, rugs, and the like. The invention is based in part on the discovery that a combination of hydrogen peroxide and a hydrophobic solvent or surfactant provides for a composition that exhibits exceptional abilities in dislodging greasy or oily soil from fabrics that can then be removed with a vacuum cleaner, mop, sponge or other device. Greasy soils are especially problematic as they usually contain an oily, fluid component as well as a particulate component. The cleaning composition is also excellent for removing conventional stains.

In one aspect, the invention is directed to a dispensable cleaner especially adapted for removing oily soils from absorbent or adsorbent surfaces, the cleaner including:

a. an effective amount of an organic solvent having a Hansen solubility parameter of less than about 10;

b. an effective amount of an emulsifying or dispersing agent;

c. an effective amount of a source of hydrogen peroxide; and d. the remainder, water.

In another aspect, the invention is directed to a method for cleaning soiled fabrics having fibers containing soil that includes the steps of:

a. forming a cleaner especially adapted for removing oily soils from absorbent or adsorbent surfaces, the cleaner having the formulation set forth above;

b. applying said cleaner to a surface of a fabric containing a soil;

c. allowing said cleaner to penetrate into said fabric; and d. removing said soil.

In a preferred embodiment, said emulsifying or dispersing agent is a surfactant that has an HLB of less than about 10. In another preferred embodiment, the method further includes the step of allowing at least some of the water to evaporate from the fabric before removing said soil.

DETAILED DESCRIPTION OF PREFERRED EMBODIMENTS

The present invention relates to an aqueous carpet cleaning formulation that generally includes:

a. an effective amount of a hydrophobic organic solvent having a Hansen solubility parameter of less than about 10;

b. an effective amount of an emulsifying or dispersing agent;

c. an effective amount of a source of hydrogen peroxide; and d. optionally, one or more other cleaner and/or aesthetic adjunct with the balance comprising water.

A critical aspect of the invention is that the presence of the hydrogen peroxide and hydrophobic organic solvent unexpectedly provides synergistic cleaning of oily and greasy stains that have been difficult to remove. No excessive brushing, mopping, or other physical treatment is required. The dislodged soil is removed by conventional means including, for example, a vacuum cleaner, mop, or sponge.

The hydrophobic organic solvent includes any suitable organic solvent or mixture of solvents that has a Hansen solubility parameter of less than about 10. This parameter is a standard used in the solvent industry and represents a combination of dispersion, polar, and hydrogen bonding forces. A table of calculated values is presented in C. M. Hansen and K. Skaarup, "Independent Calculation of the Parameter Components", *Journal of Paint Technology* 39 (1967) No. 511 and is further described in Wisniewski et. al., "Three-Dimensional Solubility Parameter: simple and effective determination of compatibility regions", *Progress in Organic Coatings*, 26 (1995) 265–274 and Robert Griffith, "Solubility Parameters", *American Ink Maker*, Dec. 15–17, 1989, which are incorporated herein. While the exact reason for the advantageous combination of hydrogen peroxide with a hydrophobic solvent of low Hansen solubility parameter in cleaning greasy soils is unknown, the Hansen solubility coefficient is known to predict the dispersion of dyes and pigments and the swelling of polymers, see C. M. Hansen, "The Three-Dimensional Solubility Parameter-Key to Paint Component Affinities", *Journal of Paint Technology*, 39 (1967) No. 505. The term "hydrophobic" is meant herein to encompass solvents which are poorly soluble in water as well as solvents that would be expected to interact with hydrophobic materials, such as greasy soils. For the present invention, suitable hydrophobic solvents have a Hansen solubility parameter of less than about 10.

Suitable hydrophobic solvents generally include, for example, glycol ethers, alcohols, ethers, ketones and esters such as acetates. Preferred solvents are ethylene glycol ethers and propylene glycol ethers, and mixtures thereof. Such solvents include, for example, ethylene glycol ethyl hexyl ether, tripropylene glycol n-butyl ether, tripropylene glycol methyl ether, dipropylene glycol n-butyl ether, dipropylene glycol t-butyl ether, dipropylene glycol n-propyl ether, propylene glycol n-butyl ether, propylene glycol t-butyl ether, dipropylene glycol methyl ether acetate, propylene glycol ethyl ether acetate, diethylene glycol ethyl ether acetate and mixtures thereof. These solvents are available from Arco Chemical Company, Newton Square, Pa. Solvents with a low Hansen solubility parameter (i.e., less than 10) may be mixed with other solvents having higher Hansen solubility parameters, such as, for example, diethylene glycol, ethylene glycol, propylene glycol, and isopropanol. Suitable solvent mixtures of hydrophobic solvents for the present cleaning composition must also have a Hansen solubility parameter of less than about 10. The hydrophobic organic solvent preferably comprises about 0.5% to 30%, more preferably about 1% to 10%, and most preferably about 2% to 5% of the cleaning composition. All percentages herein are on a weight basis.

The hydrogen peroxide acts as an oxidizing agent. The hydrogen peroxide preferably comprises about 0.1% to 20%, more preferably about 0.5% to 10%, and most preferably about 1% to 5% of the cleaning composition. Hydrogen peroxide is typically available in the form of an aqueous solution comprising about 30% to 70% $H_2O_2$.

The emulsifying or dispersing agent includes any suitable surfactant which is compatible with the organic solvent. Most preferably the surfactant is characterized by having a hydrophilic-lipophilic-balance (HLB) of less than about 10. Preferred surfactants include, for example, anionic, nonionic, and cationic surfactants and mixtures thereof. Preferred nonionic surfactants include, for example, alcohol ethoxylates and propoxylates and alkylphenol ethoxylates and propoxylates, and mixtures thereof. Preferably, the surfactant preferably comprises about 0.1% to 5%, more preferably about 0.3% to 3%, and most preferably about 0.4% to 0.6% of the cleaning composition.

The pH of the cleaning composition preferably ranges from about pH 2 to pH 10 and more preferably ranges from about pH 3 to pH 5. The cleaner may further include one or more cleaning and/or aesthetic adjuncts. These include, for example, sequestering agents, builders, fragrances, soil retardants, and mixtures thereof.

Sequestering agents and builders act to stabilize the composition against metal ions and changes in pH. Preferred stabilizers include, for example, tetrasodium ethylenediaminetetraacetic acid, which product is sold under the trademark VERSENE 100™ from Dow Chemical, Midland, Mich. and borax decahydrate, which is available from Aldrich Chemical, Milwaukee, Wis. Other sequestering agents and builders may include, for example, aminopolyphosphonates which is sold under the trademark, DEQUEST 2000™ from Monsanto Co.), phosphonates, phosphates, zeolites, lower carboxylic acids and the salts thereof, such as, acetates citrates, polyacrylates, and soaps. When employed, the sequestering agent preferably comprises from about 0.1% to 10% of the cleaning composition.

Fragrances are usually blends of volatile oils that are composed of organic compounds such as esters, aldehydes, ketones or mixtures thereof. Such fragrances are usually proprietary materials commercially available from such manufacturers as Quest, International Flavors and Fragrances, Givaudan and Firmenich, Inc. Examples of fragrances which may be suitable for use in the present invention may be found in Laufer et al., U.S. Pat. No. 3,876,551, and Boden et al, U.S. Pat. No. 4,390,448, which are incorporated herein. When employed, fragrances preferably comprise from about 0.1% to 0.5% of the cleaning composition.

Soil retardants are typically hydrocarbon and fluorocarbon polymers which protect the carpet against resoiling. Useful soil retardant polymers are sold under the trademarks, ZONYL 7950™, ZONYL 5180™, ZONYL 6885™, and ZELAN 338™ from DuPont Chemicals, Wilmington, Del., and FLUORAD FC-661 employed, the soil retardant preferably comprises from about 0.01 to 5% of the composition.

The cleaning composition of the present invention is preferably spayed directly onto stained surfaces by conventional means.

EXPERIMENTAL

Comparative evaluations were conducted to demonstrate the unexpected cleaning performance of the inventive composition. White color carpet made from 100% nylon which maximizes the contrast between a stain and the carpet was employed. Swatches (4×4 in. (10.16×10.16 cm)) were stained with heavy traffic soils or grape juice as follows:

Heavy Traffic—10 grams of Shapsburg clay soil was thoroughly mixed with 1 gram of Chevron Supreme Motor Oil® SAE 10W-40. Half a gram of this mixture was applied onto a 3×3 in (7.62×7.62 cm) area on swatches. The stain was allowed to dry completely before cleaning.

Grape Juice (WELCH'S®)—3 grams of grape juice (undiluted) was applied onto a 3×3 in (7.62×7.62 cm) area on swatches. The stain was allowed to dry completely before cleaning.

Inventive and comparative cleaning compositions were tested using the following protocol. Three grams of composition was sprayed on a stained swatch. The stain was cleaned with a damp sponge in an automatic carpet scrubbing machine with 25 swipes. Another three grams of the cleaner was applied and the scrubbing was repeated. The swatch was allowed to dry overnight before being vacuumed with a portable vacuum cleaner and evaluated with a Hunter colorimeter model 6000 without a uv filter. Four replicate readings of the swatches were made per composition. Whiteness was determined by making reflectance measurements before and after cleaning the stained swatches. Based on the reflectance reading, the amount of remaining stain and the percent stain removal were calculated.

EXAMPLE 1

In this study, the unexpected ability to clean soiled fabric by inventive cleaning composition A which comprises (1) hydrogen peroxide, (2) a hydrophobic organic solvent, tripropylene glycol methyl ether (TPM), having a Hansen solubility coefficient of 9.8, and (3) a hydrophobic surfactant (i.e., emulsifier) which product is sold under the trademark, SURFONIC L12-2.6™, having an HLB of 8.0 was demonstrated. The components that comprise each cleaning composition (as a percentage by weight) and their performance as measured by the percentage of soil removed from heavy traffic stains are listed in Table 1. As is evident, composition A was superior to composition B which did not include hydrogen peroxide, and to composition C which did not include a hydrophobic solvent or a hydrophobic surfactant. Composition A was also superior to comparative compositions D, E, and F which did not contain a hydrophobic surfactant or solvent but rather included the more hydrophilic surfactant, which product is sold under the trademark SULFONIC L12-6™ (HLB 12.4), and the more hydrophilic solvents isopropanol (HS: 12.1), ethylene glycol (HS: 16.3), and ethylene glycol butyl ether (HS: 10.2), respectively.

TABLE 1

| | | A | B | C | D | E | F |
|---|---|---|---|---|---|---|---|
| $H_2O_2$ (50%) | | 5 | 0 | 5 | 5 | 5 | 5 |
| | Hansen Solubility (HS) | | | | | | |
| TPM | 9.8 | 5 | 5 | | | | |
| Isopropanol | 12.1 | | | | 5 | | |
| Ethylene glycol | 16.3 | | | | | 5 | |
| Ethylene glycol butyl ether | 10.2 | | | | | | 5 |
| STEPANOL WAC ™ (1) | | 0.3 | 0.3 | 0.3 | 0.3 | 0.3 | 0.3 |
| | HLB | | | | | | |
| SURFONIC L12-2.6 ™ (2) | 8 | 0.1 | 0.1 | | | | |
| SURFONIC L12-6 ™ (3) | 12.4 | | | | 0.1 | 0.1 | 0.1 |
| Water | | q.s. | q.s. | q.s. | q.s. | q.s. | q.s. |
| Heavy Traffic % Soil Removed | | 80.1 | 73.7 | 73.2 | 76.1 | 71.6 | 73.4 |

(1) 30% sodium lauryl sulfate, available from Stepan Co., Northfield, Il
(2) $C_{10}$–$C_{12}$, 2.6 mole ethoxylate nonionic surfactant, available from Texaco Chemical Co., Austin, TX
(3) $C_{10}$–$C_{12}$, 6 mole ethoxylate nonionic surfactant, available from Texaco Chemical Co.

EXAMPLE 2

In this study the cleaning abilities of inventive and comparative cleaning compositions each containing, among other components: (1) 0.3%, of an anionic, hydrophilic surfactant, which is sold under the trademark Stepanol WAC™ and (2) 0.5% of a builder, which is sold under the trademark VERSENE 100™ was compared. With the exception of composition D, each cleaning composition also included 0.1% of an octylphenol 9–10 mole ethoxylate, a hydrophilic nonionic surfactant (i.e., emulsifier which is sold under the trademark TRITON x100™) available from Union Carbide Chemical & Plastics Co., Danbury, Conn. The components that comprise each cleaning composition (as a percentage by weight) and their performance as measured by the percentage of soil removed from heavy traffic stains are listed in Table 2.

As is evident, inventive compositions A and D which further included hydrogen peroxide, and a hydrophobic solvent, dipropylene glycol butyl ethyl (DPNB) were superior to the comparative cleaning compositions B, C, E, F and G that did not include both hydrogen peroxide and a hydrophobic solvent.

TABLE 2

| | | A | B | C | D | E | F | G |
|---|---|---|---|---|---|---|---|---|
| $H_2O_2$ (50%) | | 4 | 4 | 0 | 4 | 4 | 0 | 4 |
| | HS | | | | | | | |
| DPNB | 9.5 | 10 | 0 | 10 | 10 | | | |
| Ethylene glycol butyl ether | 10.2 | | | | | 10 | 10 | |
| Isopropanol | 12.1 | | | | | | | 10 |
| | HLB | | | | | | | |
| TRITON X100 ™ | 13.5 | 0.1 | 0.1 | 0.1 | 0 | 0.1 | 0.1 | 0.1 |
| STEPANOL WAC ™ | | 0.3 | 0.3 | 0.3 | 0.3 | 0.3 | 0.3 | 0.3 |
| VERSENE 100 ™ | | 0.5 | 0.5 | 0.5 | 0.5 | 0.5 | 0.5 | 0.5 |
| Water | | q.s. | q.s. | q.s. | q.s. | q.s. | q.s. | q.s. |
| % Heavy Traffic Soil Removed | | 73.5 | 62.1 | 66.2 | 70.2 | 61.7 | 57.5 | 62.8 |

EXAMPLES 3, 4, AND 5

Three sets of tests were conducted using different cleaning compositions to remove heavy traffic soil or grape juice stains. In the first study, the cleaning benefit of combining a hydrophobic surfactant (composition A) versus a hydrophilic surfactant (composition B) to a cleaning composition comprising a hydrophobic solvent, TPM, and hydrogen peroxide was demonstrated. Composition A comprised: (1) 4% of $H_2O_2$ (50%), (2) 5% TPM (HS:9.8) (3) 0.5% SURFONIC L12-2.6™ (HLB: 8.0), (4) 0.4% VERSENE 100™, (5) 0.3% STEPANOL WAC™, and (6) the balance, water. Composition B had the same components except that SURFONIC L12-6™ (HLB: 12.6) was used instead of SURFONIC L12-2.6™. Composition A removed 81.3% of the heavy traffic soil whereas composition B removed only 76.2%. As is evident, composition A containing the hydrophobic nonionic surfactant provided better stain removal that composition B which contained the hydrophilic nonionic surfactant.

In the second study, the cleaning benefit of combining a hydrophobic surfactant (composition C) versus a hydrophilic surfactant (composition D) to a cleaning composition comprising a the hydrophilic solvent, isopropanol, and hydrogen peroxide was demonstrated. Composition C comprised: (1) 4% of $H_2O_2$ (50%), (2) 5% isopropanol (HS:12.1) (3) 0.5% SURFONIC L12-2.6™(HLB: 8.0), (4) 0.3% STEPANOL WAC™, and (5) the balance, water. Composition D had the same components except that SURFONIC L12-6™ (HLB: 12.6) was used instead of SURFONIC L12-2.6™. Composition C removed 73.4% of the heavy traffic soil whereas composition D removed only 65%. As is apparent, even when using the hydrophilic solvent isopropanol (Hansen solubility parameter of 12.1), the combination of hydrogen peroxide with a hydrophobic nonionic surfactant provided better soil removal than the combination of hydrogen peroxide with a hydrophilic nonionic surfactant.

In the third study, the ability of the cleaning composition to remove grape juice stains was demonstrated. Two formulations were tested. Composition E comprised: (1) 4% of $H_2O_2$ (50%), (2) 4% TPM (HS:9.8) and (3) 1% isopropanol (HS:12.1) (4) 0.1% SURFONIC L12-2.6™ (HLB: 8), (5) 0.3% STEPANOL WAC™, and (6) the balance, water. Composition F had the same components except that 5% isopropanol was used and no TPM was used. Composition E removed 80% of the juice stain and composition F removed 76.7%. The data show that a cleaning composition having hydrogen peroxide in combination with mixed hydrophilic and hydrophobic solvents, TPM (Hansen solubility parameter of 9.8) and isopropanol (Hansen solubility parameter of 12.1), is more effective than one having hydrogen peroxide in combination with the hydrophilic solvent isopropanol alone.

EXAMPLE 6

The soil removing abilities of aqueous cleaning compositions containing (1) 4% of $H_2O_2$ (50% solution), (2) 0.3% STEPANOL WAC™ (anionic surfactant) and (3) 10% organic solvent were measured. The organic solvent component that is present in each cleaning composition and the performances as measured by the percentage of soil removed from heavy traffic stains are listed in Table 3. The data show that cleaning compositions having solvents with Hansen solubility parameters below 10 are superior to those with solvents with Hansen solubility parameters above 10. As a comparison, aqueous cleaning compositions comprising (1) 4% $H_2O_2$ (50% solution), (2) 0.3% STEPANOL WAC™ but without any organic solvent removed 78.7% of the stains.

TABLE 3

| Solvent | Hansen Solubility | % Soil Removed |
|---|---|---|
| Propylene glycol n-butyl ether | 9.8 | 85.5 |
| Dipropylene glycol n-propyl ether | 9.6 | 89.6 |
| Dipropylene glycol butyl ether | 9.5 | 87.8 |
| Propylene glycol methyl ether | 11.1 | 76.7 |
| Propylene glycol n-propyl ether | 10.3 | 76.4 |
| Ethylene glycol butyl ether | 10.2 | 79.9 |
| Ethylene glycol | 16.3 | 81.4 |
| Isopropanol | 12.1 | 77.5 |

EXAMPLES 7 & 8

The superior soil removing capabilities of an inventive aqueous composition A consisting essentially of hydrogen peroxide and an organic solvent having a Hansen solubility parameter of 9.5 versus an aqueous composition B consisting essentially of hydrogen peroxide and an organic solvent having a Hansen solubility parameter of 11.7 is shown in Table 4, which lists the components for each formulation.

TABLE 4

| | | A | B |
|---|---|---|---|
| $H_2O_2$ (50%) | | 4 | 4 |
| | HS | | |
| DPNB | 9.5 | 3 | |
| Ethylene glycol hexyl ether | 11.7 | | 3 |
| Water | | q.s. | q.s. |
| % Soil Removed | | 65.2 | 62.8 |

The stain removing capabilities of inventive compositions can be enhanced by increasing the amount of hydrogen peroxide and/or suitable organic solvent as shown in Table 5. As is apparent, both cleaning compositions A and B have the same components but B has higher concentrations of both hydrogen peroxide and organic solvent PNB. The latter exhibited higher grape juice stain removing capabilities. Composition C which does not contain hydrogen peroxide but does have 20% organic solvent shows less stain removal capabilities than composition B.

TABLE 5

| | A | B | C |
|---|---|---|---|
| $H_2O_2$ (50%) | 0.5 | 20 | |
| PNB (HS:9.8) | 0.5 | 20 | 20 |
| CRODASINIC LS30 ™ | 0.3 | 0.3 | 0.3 |
| Water | q.s | q.s. | q.s. |
| % Juice Stain Removed | 70.8 | 79.1 | 69.6 |

An is an anionic surfactant comprising 30% sodium lauroyl sarcosinate is sold under the trademark CRODASINIC LS30™, from Croda Chemical, North Humberside, UK

EXAMPLE 9

The soil removing abilities of aqueous cleaning compositions containing (1) 4% of $H_2O_2$ (50% solution), (2) 5% propylene glycol n-butyl ether (HS: 9.8) and (3) different amphoteric, anionic, or nonionic surfactants were tested. The surfactant component that is present in each cleaning composition (as a percentage by weight) and their performance as measured by the percentage of soil removed from heavy traffic stains are listed in Table 7. Except as noted in the table, all surfactants are anionic. The data show that cleaning compositions can be used with a variety of surfactant types.

TABLE 7

| Active Ingredient | Surfactant product is sold under the following corresponding trademarks | % Juice stain removed |
|---|---|---|
| 30% cocamine oxide (amphoteric) | BARLOX 12 ™ (1) | 66 |
| 40% sodium dodecylbenzenesulfonate | BIOSOFT D40 ™ (2) | 72.8 |
| 40% sodium C14–16 olefin sulfonate | BIOTERGE AS-40 ™ (2) | 65.9 |
| 35% sodium naphthalenesulfonate | LONZAINE 12C ™ (1) | 76.2 |
| lauramide monoethanolamine (nonionic) | NINOL LMP ™ (2) | 76 |
| 30% sodium laureth sulfate | STEOL CS-230 ™ (2) | 70.8 |
| 70% sodium lauryl sulfoacetate | LANTHANOL LAL ™ (2) | 76.3 |
| 50% palmityl trimethylammonium chloride (cationic) | ADOGEN 444 ™ (3) | 68.3 |
| 95% sodium alkylnaphthalenesulfonate | PETRO BAF ™ (3) | 72.5 |

TABLE 7-continued

| Active Ingredient | Surfactant product is sold under the following corresponding trademarks | % Juice stain removed |
|---|---|---|
| 30% magnesium laurylsulfate | STEPANOL MG ™ (2) | 73.5 |
| 50% $C_{12}$—$C_{16}$ alkylpolyglycoside (nonionic) | GLYCOPON 625CS ™ (4) | 71 |
| 34% disodium laurethsulfosuccinate | STEPAN MILDSL3 ™ (2) | 73.5 |

(1) Lonza Inc., Fairlawn, NJ.
(2) Stepan Chemical Co., Northfield, IL.
(3) Witco Chemical Co., Dublin, OH.
(4) Henkel Corp., Cincinnati, OH.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An aqueous dispensable cleaner especially adapted for removing oily soils from absorbent or adsorbent surfaces, the cleaner comprising:

a. from about 0.5 wt % to 30 wt % of a hydrophobic solvent or a hydrophobic solvent mixture provided that when a single hydrophobic solvent is present it has a Hansen solubility parameter of less than 10 and that when a hydrophobic solvent mixture is present the mixture has a Hansen solubility parameter of less than 10 wherein said hydrophobic solvent or hydrophobic solvent mixture is selected from glycol ethers;

b. from about 0.1 wt % to 5 wt % of a nonionic surfactant that has an HLB of less than about 10 selected from the group consisting of alcohol ethoxylates and propoxylates, alkylphenol ethoxylates and propoxylates, and mixtures thereof;

c. from about 0.1 wt % to 20 wt % of a water soluble source of hydrogen peroxide; and d. water, which comprises at least about 70% of the cleaner.

2. The cleaner of claim 1 wherein water comprises at least about 87 wt % of the cleaner.

3. The cleaner of claim 1 further comprising at least one other cleaning and/or aesthetic adjunct.

4. The cleaner of claim 3 wherein said cleaning and/or aesthetic adjunct is selected from the group consisting of sequestering agents, builders, fragrances, soil retardants, and mixtures thereof.

5. The cleaner of claim 1 wherein said hydrophobic solvent or hydrophobic solvent mixture comprises 1 wt % to 10 wt % of the cleaner.

6. The cleaner of claim 5 wherein hydrogen peroxide comprises 0.5 wt % to 10 wt % of the cleaner.

7. The cleaner of claim 6 wherein said nonionic surfactant comprises 0.3 wt % to 3 wt % of the cleaner.

8. A method for cleaning soiled fabrics having fibers containing soil that comprises the steps of:

a. forming an aqueous cleaner especially adapted for removing oily soils from absorbent or adsorbent surfaces, the cleaner comprising:

i. from about 0.5 wt % to 30 wt % of a hydrophobic solvent or hydrophobic solvent mixture provided that when a single hydrophobic solvent is present it has a Hansen solubility parameter of less than 10 and that when a hydrophobic solvent mixture is present the mixture has a Hansen solubility parameter of less than 10 wherein said hydrophobic solvent or hydrophobic solvent mixture is selected from glycol ethers;

ii. from about 0.1 wt % to 5 wt % of a nonionic surfactant that has an HLB of less than about 10 selected from the group consisting of alcohol ethoxylates and propoxylates, alkylphenol ethoxylates and propoxylates, and mixtures thereof;

iii. from about 0.1 wt % to 20 wt % of a water soluble source of hydrogen peroxide; and iv. water which comprises at least about 70% of the cleaner;

b. applying said cleaner to a surface of a fabric containing a soil;

c. allowing said cleaner to penetrate into said fabric; and d. removing said soil.

9. The method of claim 8 wherein water comprises at least about 87 wt % of the cleaner.

10. The method of claim 8 wherein the cleaner further comprises at least one other cleaning and/or aesthetic adjunct.

11. The method of claim 10 wherein the cleaning and/or aesthetic adjunct is selected from the group consisting of sequestering agents, builders, fragrances, soil retardants, and mixtures thereof.

12. The method of claim 8 wherein said hydrophobic solvent or hydrophobic solvent mixture comprises 1 wt % to 10 wt % of the cleaner.

13. The method of claim 12 wherein hydrogen peroxide comprises 0.5 wt % to 10 wt % of the cleaner.

14. The method of claim 13 wherein the nonionic surfactant comprises 0.3 wt % to 3 wt % of the cleaner.

* * * * *